US006507318B2

(12) United States Patent
Ito et al.

(10) Patent No.: US 6,507,318 B2
(45) Date of Patent: Jan. 14, 2003

(54) ANTENNA APPARATUS AND PORTABLE COMMUNICATION APPARATUS

(75) Inventors: Hiroki Ito, Tokyo (JP); Katsumi Okayama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/800,864

(22) Filed: Mar. 7, 2001

(65) Prior Publication Data

US 2002/0005808 A1 Jan. 17, 2002

(30) Foreign Application Priority Data

Mar. 9, 2000 (JP) ..... 2000-071089

(51) Int. Cl.[7] ..... H01Q 1/24
(52) U.S. Cl. ..... 343/702; 343/700 MS
(58) Field of Search ..... 343/700 MS, 702, 343/846, 848; 455/90; H01Q 1/24

(56) References Cited

U.S. PATENT DOCUMENTS 6,147,650 A * 11/2000 Kawahata et al. ... 343/700 MS
6,229,485 B1 * 5/2001 Ito et al. ..... 343/700 MS
2002/0033772 A1 * 3/2002 Johnson et al. ..... 343/702

* cited by examiner

*Primary Examiner*—Hoanganh Le
(74) *Attorney, Agent, or Firm*—Jay H. Maioli

(57) ABSTRACT

An antenna apparatus and a portable communication apparatus are disclosed to reduce the quantity of electromagnetic waves absorbed by a human body in a portable communication apparatus even in case of any wireless communication frequency corresponding to at least two or more wireless communication systems different in wireless communication frequency, respectively. A dielectric 13 having the frequency dispersibility that varies relative dielectric constant with wireless communication frequencies can equate an electrical length L2 from one end to the other end of a conductive flat plate 11 at two or more types of wireless communication frequencies. This makes it possible to make an impedance at an open end of a single conductive flat plate 11 almost equivalent for any wireless communication frequencies to suppress the surface current, and thus the quantity of electromagnetic waves absorbed by a human body to be reduced.

10 Claims, 2 Drawing Sheets

ANTENNA APPARATUS AND PORTABLE COMMUNICATION APPARATUS

BACKGROUND OF THE INVENTION

1. Field of the Invention

The present invention relates to an antenna apparatus and a portable communication apparatus, and more particularly is suitably applied to a so-called multi-band portable communication apparatus made correspondent to at least two or more types of wireless communication systems, for example, different in used wireless communication frequency.

2. Description of the Related Art

In recent years, portable communication apparatuses have a tendency to become insufficient in the number of lines with a rapid spread if using lines for a single wireless communication system. Accordingly, it is considered that two types of wireless communication systems using different frequency bands are jointly used to ensure the required number of lines and there has been developed a terminal capable of using two types of wireless communication systems by means of a single portable communication apparatus with a significant progress in downsizing and weight-lightening technique.

On the other hand, there has been a problem of the effect of the electromagnetic waves irradiated from the portable communication apparatus on the human body during the telephone call. The absorption factor of electromagnetic waves absorbed by a specific region (chiefly head) of a human body per time and per mass during the telephone call has been defined as a local average Specific Absorption Rate (SAR) and it has been required to suppress a maximum of local average SARs below a prescribed value.

As shown in FIG. 1, reference numeral 1 denotes a portable communication apparatus developed for the purpose of suppressing a maximum of local average SARs below a prescribed value as a whole. A circuit substrate which is not illustrated necessary for wireless communication is housed inside a casing which is not illustrated. The circuit substrate is covered with a shield case 2 as a ground member.

With respect to this portable communication apparatus 1, covering the circuit substrate housed inside with a shield case 2 prevents a transmitter/receiver circuit or various other circuits packaged on the circuit substrate from being badly affected by each other and from badly affecting an antenna 4 or other equipment.

Besides, the inside circuit substrate is so arranged as to generate a transmission signal of a given signal type by a transmitter/receiver circuit for communications with a base station, transmit it from the antenna 4 via an antenna feeder part 3 to a base station and demodulate the reception signal received by the antenna 4 after taking it in via the antenna feeder part 3.

Here, the antenna 4 comprises a rod-shaped rod antenna, for example, made of a conductive wire rod. Other than this, it is possible to utilize a helical antenna formed by winding a conductive wire rod in a helical or various types of antennas including a complex of the above antennas in an expansion and contraction type.

With this antenna 4, the relevant antenna 4 alone does not operate as an antenna, and a high-frequency current flows from the antenna feeder part 3 also into a ground conductor of the circuit substrate or into a shield case 2 with the result that the portable communication apparatus 1 operates as an antenna as a whole.

The portable communication apparatus 1 is so arranged as to measure a local average SAR during the telephone call as shown in FIG. 2. And at this time it has been confirmed that a spot at which the local average SAR indicates a maximum (hereinafter, referred to as hot spot) lies near an ear coming into contact with a speaker 7.

This is considered to be because the speaker 7 of a portable communication apparatus 1 is used in contact with the ear of a human body or because the ground conductor of a circuit substrate present behind the speaker 7 or the shield case 2 operates as part of the antenna to irradiate electromagnetic waves.

Such being the case, with the portable communication apparatus 1 shown in FIG. 1, a conductive flat plate 5 is located at a position slightly floating from the top surface 2A of the shield case 2 opposite the speaker 7 which is not illustrated so as to be parallel with the top surface 2A.

At this time, in the conductive flat plate 5, one end is short-circuited to the shield case 2 by a short-circuiting conductor 6 while the other end is made to be electrically opened from the shield case 2 toward above as represented by the arrowhead a. The length L1 from the short-circuit end to the open end is chosen equal to a quarter of the wavelength $\lambda/4$ of a wireless communication frequency.

Thereby, in the portable communication apparatus 1, the impedance between the conductive flat plate 5 and the shield case 2 becomes almost "0" at the short-circuit end, but the impedance at the open end approaches to an infinity and as a result, a high-frequency current becomes difficult in flowing from the vicinity of the antenna feeder part 3 to the conductive flat plate 5 or the shield case 2.

Incidentally, it has experimentally proven in the conductive flat plate 5 that the impedance at the open end reaches a maximum when the length L1 from the short-circuit end to the open end is chosen equal to a quarter of the wavelength $\lambda/4$ of a wireless communication frequency.

Accordingly, in the portable communication apparatus 1, a high-frequency current becomes difficult in flowing from the vicinity of the antenna feeder part 3 to the conductive flat plate 5 or the shield case 2, so that the radiative quantity of electromagnetic waves irradiated from the conductive flat plate 5 and the shield case 2 is reduced, thereby enabling the local average SAR near an ear to be reduced.

However, in a portable communication apparatus 1, since the length L1 from the short-circuit end to the open end in the conductive flat plate 5 is determined by a wireless communication frequency, it was difficult to respectively reduce the local average SAR corresponding to two types of wireless communication systems different in wireless communication frequency unless two types of conductive flat plates respectively different in length L1 from the short-circuit end to the open end are provided.

SUMMARY OF THE INVENTION

In view of the foregoing, an object of this invention is to provide an antenna apparatus and a portable communication apparatus capable of respectively reducing the quantity of electromagnetic waves absorbed by a human body corresponding to at least two or more wireless communication systems different in wireless communication frequency, even in case of any wireless communication frequency.

The foregoing object and other objects of the invention have been achieved by the provision of an antenna apparatus and a portable communication apparatus which comprise a grounded conductor; a conductive flat plate with one end electrically short-circuited to the grounded conductor and the other end electrically opened to the grounded conductor; and a dielectric, inserted in between the conductive flat plate and the grounded conductor, with the electrical length from the one end to the other end of the conductive flat plate made identical for at least two or more types of wireless communication frequencies on the basis of the frequency dispersibility.

Thereby, the electrical length from the one end to the other end of the conductive flat plate becomes identical for two or more types of wireless communication frequencies depending on a dielectric, so that in case of performing communication via an antenna element for two or more types of wireless communication frequencies, the impedance at one end of a single conductive flat plate can be made almost equivalent for any wireless communication frequency to suppress the surface current, thus enabling the quantity of electromagnetic waves absorbed by a human body.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Figure 1:
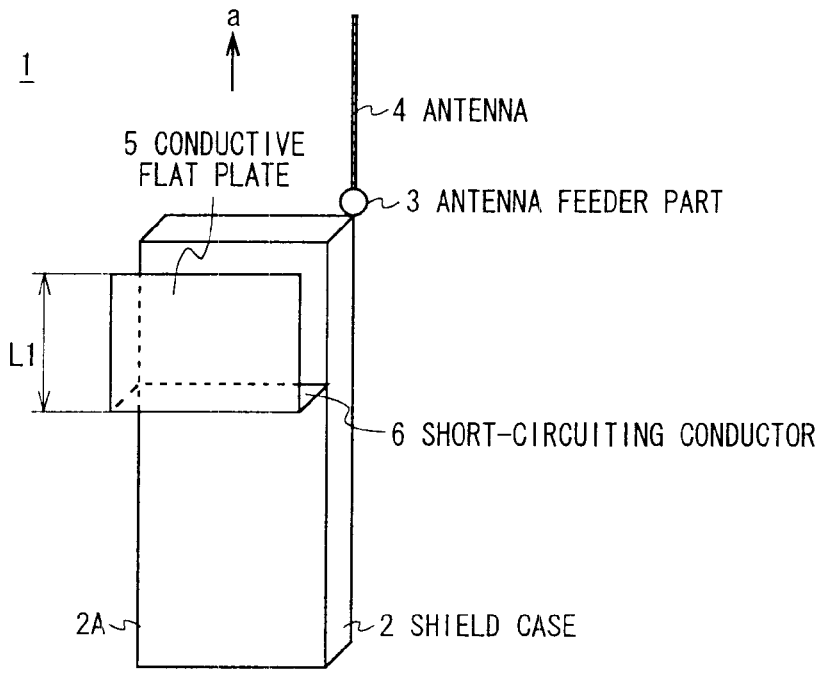
FIG. 1 (PRIOR ART)
FIG. 1 is an outline perspective view showing an internal structure of a conventional portable communication apparatus.
Figure 2:
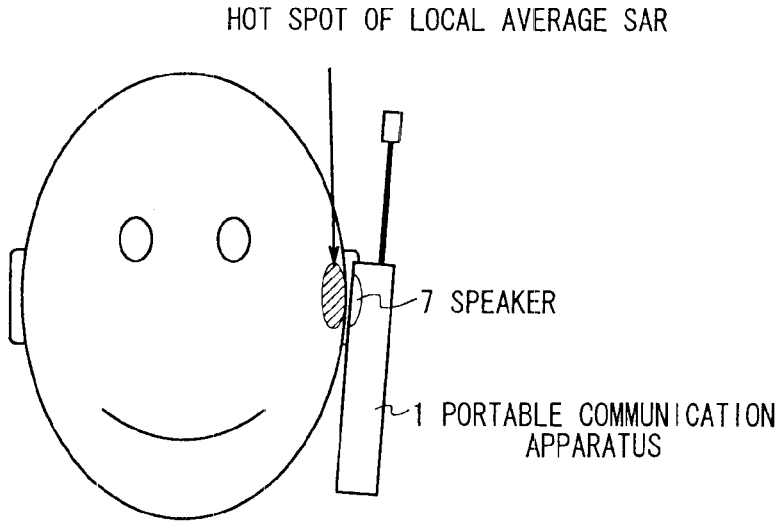
FIG. 2 (PRIOR ART)
FIG. 2 is an outline drawing showing a hot spot of a local average SAR.
Figure 3:
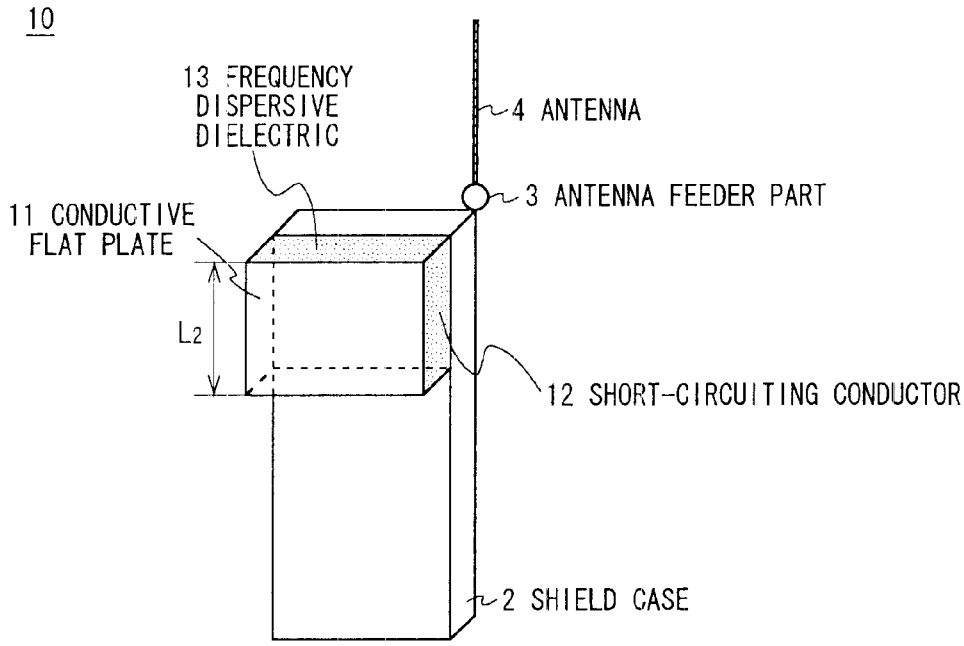
FIG. 3 is an outline perspective view showing an internal structure of a portable communication apparatus according to the present invention.

Preferred embodiments of this invention will be described with reference to the accompanying drawings:

In FIG. 3 with like symbols attached to those corresponding to parts of FIG. 1, reference numeral 10 denotes a portable communication apparatus as a whole. A circuit substrate necessary for wireless communication is housed inside a casing formed of a nonconductive material and covered with a shield case 2 as a ground member.

With this portable communication apparatus 10, covering the circuit substrate housed inside with a shield case 2 prevents a transmitter/receiver circuit or various other circuits packaged on the circuit substrate from being badly affected by each other and from badly affecting an antenna 4 or other equipment.

Besides, the inside circuit substrate is so arranged as to generate a transmission signal of a given signal type by a transmitter/receiver circuit for communications with a base station, transmit it from the antenna 4 via an antenna feeder part 3 to a base station and demodulate the reception signal received by the antenna 4 after taking it in via the antenna feeder part 3.

Here, the antenna 4 comprises a rod-shaped rod antenna made of a conductive wire rod, the relevant antenna 4 alone does not operate as an antenna, and a high-frequency current flows from the antenna feeder part 3 also into a ground conductor of the circuit substrate or into a shield case 2 with the result that the portable communication apparatus 10 operates as an antenna as a whole.

Also in this case, assuming that in the portable communication apparatus 10, a spot at which the local average SAR becomes a maximum lies near the neighbor of an ear coming into contact with a speaker (unillustrated), a description will be made below.

With the portable communication apparatus 10, a conductive flat plate 11 is located at a position slightly floating from the top surface 2A of the shield case 2 opposite the speaker so as to be nearly parallel with the top surface 2A. One end of the conductive flat plate 11 is short-circuited to the shield case 2 by a short-circuiting conductor 12 while the other end is electrically opened from the shield case 2 upward as represented by the arrowhead a.

At this time, in between the conductive flat plate 11 and the shield case 2, a dielectric of a frequency dispersibility having the relative dielectric constant varying with frequencies (hereinafter, referred to as frequency dispersive dielectric) 13 is inserted.

This frequency dispersive dielectric 13 is formed by injecting a hexagonal ferrite into an insulating substance such as rubber or resin and hardening the mixture and so arranged as to vary in relative dielectric constant with frequencies.

As compositions of such hexagonal ferrites, $BaFe_{12-2X}Me1_XMe2_XO_{19}$, $SrFe_{12-2X}Me1_XMe2_XO_{19}$ and the like mentioned, where Me1 represents a tetravalent metal ion such as Ti, Zr or Sn and Me2 represents a divalent metal ion such as Co, Mn, Zn, Cu, Mg or Ni.

Here, with respect to either of two wireless communication frequencies comprising a first $f_1$ and a second $f_2$, the portable communication apparatus 10 employs one type of dielectric flat plate 11 alone so that the impedance at the open end can be brought close to an infinity and the principle of this will be described below.

Namely, the wavelength $\lambda_1$ at the first wireless communication frequency $f_1$ for the first relative dielectric constant $\in_1$ is expressed in terms of the following formula:

$$\lambda_1 = \frac{\lambda_{01}}{\sqrt{\epsilon_1}}, \tag{1}$$

Here, $\lambda_{01}$ denotes the wavelength in air not via any dielectric at the first wireless communication frequency $f_1$ and is expressed in terms of the following formula:

$$\lambda_{01} = \frac{C}{f_1} \quad (C\text{: propagation velocity, } 3.0\times10^8\ [\text{m/s}]), \tag{2}$$

Besides, the wavelength $\lambda_2$ at the second wireless communication frequency $f_2$ for the second relative dielectric constant $\in_2$ is expressed in terms of the following formula:

$$\lambda_2 = \frac{\lambda_{02}}{\sqrt{\epsilon_2}}, \tag{3}$$

Here, $\lambda_{02}$ denotes the wavelength in air not via any dielectric at the second wireless communication frequency $f_2$ and is expressed in terms of the following formula:

$$\lambda_{02} = \frac{C}{f_2} \quad (C\text{: propagation velocity, } 3.0 \times 10^8 \text{ [m/s]}), \tag{4}$$

When Equations (1) and (3) are expanded so as to satisfy the following relation:

$$\lambda_1 = \lambda_2 \tag{5},$$

The following equation is obtained:

$$\frac{f_1}{f_2} = \left[\frac{\epsilon_2}{\epsilon_1}\right]^{1/2}, \tag{6}$$

And further by expanding Equation (6), the following equation is obtained:

$$\epsilon_2 = \frac{\epsilon_1 \cdot f_1^2}{f_2^2} \tag{7}$$

Namely, the ratio of the first relative dielectric constant $\in_1$ at the first wireless communication frequency $f_1$ to the second relative dielectric constant $\in_2$ at the second wireless communication frequency $f_2$ becomes almost equal to a square of the inverse of the ratio of the first wireless communication frequency $f_1$ to the second wireless communication frequency $f_2$.

Figure 4:
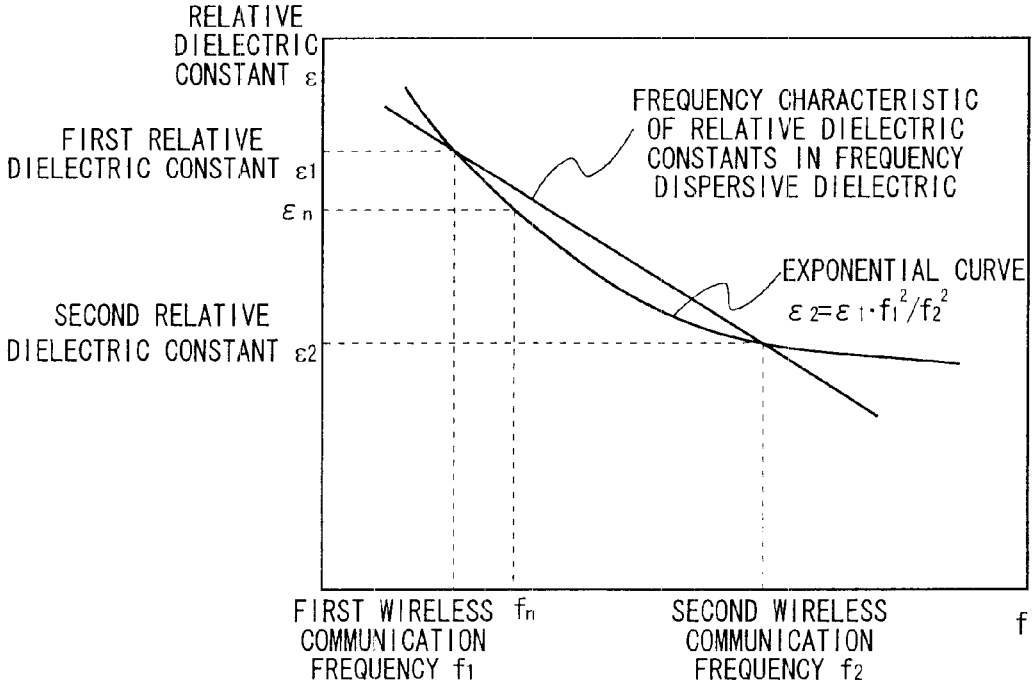
FIG. 4 is a characteristic graph showing a frequency characteristic of relative dielectric constants in a frequency dispersive dielectric.

Actually, on the exponential curve satisfying Equation (7), as shown in FIG. 4, relative dielectric constants $\in_n$ corresponding to individual wireless communication frequencies $f_n$ are present and wavelengths $\lambda_n$ for individual wireless communication frequencies $f_n$ are expressed in terms of the following formula:

$$\lambda_n = \frac{\lambda_{0n}}{\sqrt{\epsilon_n}}, \tag{8}$$

Which means that all wavelengths become identical in length by using respective relative dielectric constants $\in_n$. Incidentally, $\lambda_{0n}$ is a wavelength in air not via any dielectric at the n-th wireless communication frequency $f_n$.

Meanwhile, in the conductive flat plate 11, the impedance at the open end approaches to an infinity if the length L2 from the short-circuit end to the open end is chosen to a quarter of the wireless communication wavelength $\lambda/4$.

Thus, in a portable communication apparatus 10 according to the present invention, by inserting a frequency dispersive dielectric 13 of a frequency characteristic such as crossing the exponential curve satisfying Equation (7) at the first wireless communication frequency $f_1$ and the second wireless communication frequency $f_2$ in between the conductive flat plate 11 and the shield case 2, the length L2 from the short-circuit end to the open end of the conductive flat plate 11 can be made almost equal to the length calculated by multiplying a quarter of the wavelength $\lambda_1/4$ at the first wireless communication frequency $f_1$ by a square root of the inverse of the first relative dielectric constant $\in_1$.

In this case, the length L2 from the short-circuit end to the open end of the conductive flat plate 11 can be expressed in terms of the following formula:

$$L2 = \frac{\lambda_1}{4} \times \frac{1}{\sqrt{\epsilon_1}}, \tag{9}$$

Besides, in the portable communication apparatus 10, by inserting a frequency dispersive dielectric 13 in between the conductive flat plate 11 and the shield case 2, the length L2 from the short-circuit end to the open end of the conductive flat plate 11 can be made almost equal to the length calculated by multiplying a quarter of the wavelength $\lambda_2/4$ at the second wireless communication frequency $f_2$ by a square root of the inverse of the second relative dielectric constant $\in_2$.

In this case, the length L2 from the short-circuit end to the open end of the conductive flat plate 11 can be expressed in terms of the following formula:

$$L2 = \frac{\lambda_2}{4} \times \frac{1}{\sqrt{\epsilon_2}}, \tag{10}$$

Based on Equations (1) and (2), the wavelength $\lambda_1$ for a first wireless communication frequency $f_1$ equal to 900 MHz, for example, becomes $\lambda_1$=0.33 m/$\sqrt{\in_1}$. The length L2 from the short-circuit end to the open end of the conductive flat plate 11 becomes (0.33 m/4$\sqrt{\in_1}$)×(1/$\sqrt{\in_1}$)=0.0833 m/$\in_1$, based on Equation (9).

In contrast, based on Equations (3) and (4), the wavelength $\lambda_2$ for a second wireless communication frequency $f_2$ equal to 1.8 GHz becomes $\lambda_2$=0.166 m/$\sqrt{\in_2}$ and the length L2 from the short-circuit end to the open end of the conductive flat plate 11 becomes (0.166 m/4$\sqrt{\in_2}$)×(1/$\sqrt{\in_2}$)= 0.0416 m/$\in_2$, based on Equation (10).

Thus, supposing that the first relative dielectric constant $\in_1$ in the frequency dispersive dielectric 13 is "2" and the second relative dielectric constant $\in_2$ is "1", the length L2 from the short-circuit end to the open end of the conductive flat plate 11 becomes 4.16 cm for both regardless of whether the first wireless communication frequency $f_1$ (900 MHz) or the second wireless communication frequency $f_2$ (1.8 GHz).

In the above arrangement, since the portable communication apparatus 10 is so arranged as to insert a frequency dispersive dielectric 13, having the relative dielectric constant varying with frequencies, in between the conductive flat plate 11 and the shield case 2, a conductive flat plate 11 of such a physical length (length L2 from the short-circuit end to the open end) can be used as making the impedance of the open end close to an infinity for either of the first wireless communication frequency $f_1$ or the second wireless communication frequency $f_2$.

Thereby, the portable communication apparatus 10 has no need for the provision of two different types of conductive flat plates of lengths L2 corresponding to a quarter of the respective wavelength $\lambda/4$ for two different types of wireless communication frequencies $f_1$ and $f_2$ and accordingly can be simplified in configuration by such a benefit.

Besides, in the portable communication apparatus 10, since a high frequency is made difficult in flowing in the conductive flat plate 11 or the shield case 2 both for the first wireless communication frequency $f_1$ and for the second wireless communication frequency $f_2$ so as to reduce the radiation of electromagnetic waves, the local average SAR near an ear can be securely reduced both for the first wireless communication frequency $f_1$ and for the second wireless communication frequency $f_2$.

Incidentally, in the above embodiment, there was described a case where the local average SAR was so arranged as to be reduced for two types of wireless communication frequencies, but the present invention is not limited to this and the local average SAR can be so arranged as to be reduced by raising the impedance of the open end in the conductive flat plate 11 for three types of wireless communication frequencies.

In this case, it is only necessary to insert a frequency dispersive dielectric 13 of such a frequency characteristic in between the conductive flat plate 11 and the shield case 2 as crossing the exponential curve satisfying Equation (7), as shown in FIG. 4 at the first wireless communication frequency $f_1$, the second wireless communication frequency $f_2$ and the third wireless communication frequency $f_3$.

Besides, in the above embodiment, there was described a case where a frequency dispersive dielectric 13 was so arranged as to be formed by injecting a hexagonal ferrite into an insulating substance, but the present invention is not limited to this and a frequency dispersive dielectric 13 can be so arranged as to be formed by injecting various other substances into an insulating substance which have a frequency dispersibility that the first relative dielectric constant $\in_1$ and the second relative dielectric constant $\in_2$ satisfy Equation (6).

Furthermore, in the above embodiment, there was described a case where a conductive flat plate 11 is located at a position slightly floating from the top surface 2A of the shield case 2 so as to be opposed to the speaker, but the present invention is not limited to this and a conductive flat plate 11 can be located on the shield case 2 so as to be opposed to a site (hot spot) at which the local average SAR indicates a large value.

Still further, in the above embodiment, there was described a case where the length L2 from the short-circuit end to the open end of the conductive flat plate 11 was chosen almost equal to a quarter of the wavelength $\lambda/4$, but the present invention is not limited to this and the length L2 can be chosen to various other lengths corresponding to desired impedances to be set up at the open end.

Yet further, in the above embodiment, there was described a case where an antenna 4 comprising a rod antenna was so arranged as to be used as an antenna element, but the present invention is not limited to this and various other antenna elements such as helical antenna can be so arranged as to be used.

Yet further, in the above embodiment, there was described a case where the antenna 4 is so arranged as to be connected to a transmitter/receiver circuit via the antenna feeder part 3, but the present invention is not limited to this and the antenna 4 can be so arranged as to be connected to a transmitter circuit exclusively for transmission.

Yet further, in the above embodiment, there was described a case where the present invention was so arranged to be applied to a portable communication apparatus 10, but the present invention is not limited to this and the present invention can be so arranged to be applied to various other portable communication apparatuses such as transceiver for performing wireless communication.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An antenna apparatus comprising:

a grounded conductor;

a conductive flat plate with one end electrically short-circuited to said grounded conductor and an other end electrically opened to said grounded conductor; and a dielectric, disposed between said conductive flat plate and said grounded conductor, formed with an electrical length from the one end to the other end of said conductive flat plate equal for a plurality of wireless communication frequencies based on a frequency dispersibility, wherein in said dielectric, the ratio of a first relative dielectric constant at a first wireless communication frequency to a second relative dielectric constant at a second wireless communication frequency among said plurality of wireless communication frequencies becomes substantially equal to a square of the inverse of the ratio of said first wireless communication frequency to said second wireless communication frequency.

2. The antenna apparatus according to claim 1, wherein the electrical length from the one end to the other end of said conductive flat plate is made substantially equal to a length calculated by multiplying a quarter of the wavelength of said first wireless communication frequency by a square root of the inverse of said first relative dielectric constant.

3. The antenna apparatus according to claim 1, wherein the electrical length from the one end to the other end of said conductive flat plate is made substantially equal to a length calculated by multiplying a quarter of the wavelength of said second wireless communication frequency by a square root of the inverse of said second relative dielectric constant.

4. The antenna apparatus according to claim 1, wherein said dielectric is formed of a hexagonal ferrite and an insulating substance.

5. The antenna apparatus according to claim 1, wherein said conductive flat plate is provided on said grounded conductor at a location nearest to a specific region of a human body whereat a greatest portion of electromagnetic waves generated by a surface current flowing into said grounded conductor are absorbed.

6. A portable communication apparatus comprising:

a grounded conductor;

a conductive flat plate with one end electrically short-circuited to said grounded conductor and an other end electrically opened to said grounded conductor; and a dielectric, disposed between said conductive flat plate and said grounded conductor, formed with an electrical length from the one end to the other end of said conductive flat plate equal for a plurality of wireless communication frequencies based on a frequency dispersibility, wherein in said dielectric, the ratio of a first relative dielectric constant at a first wireless communication frequency to a second relative dielectric constant at a second wireless communication frequency among said plurality of wireless communication frequencies becomes substantially equal to a square of the inverse of the ratio of said first wireless communication frequency to said second wireless communication frequency.

7. The portable communication apparatus according to claim 6, wherein the electrical length from the one end to the other end of said conductive flat plate is made substantially equal to a length calculated by multiplying a quarter of the wavelength of said first wireless communication frequency by a square root of the inverse of said first relative dielectric constant.

8. The portable communication apparatus according to claim 6, wherein the electrical length from the one end to the other end of said conductive flat plate is made substantially equal to a length calculated by multiplying a quarter of the wavelength of said second wireless communication frequency by a square root of the inverse of said second relative dielectric constant.

9. The portable communication apparatus according to claim 6, wherein said dielectric is formed of a hexagonal ferrite and an insulating substance.

10. The portable communication apparatus according to claim 6, wherein said conductive flat plate is provided on said grounded conductor at a location nearest to a specific region of a human body whereat a greatest portion of electromagnetic waves generated by a surface current flowing into said grounded conductor are absorbed.

* * * * *